United States Patent [19]

King

[11] 4,381,102

[45] * Apr. 26, 1983

[54] SHROUD SUPPORT AND METHOD FOR SHROUD ENGAGEMENT WITH TEEMING VALVE

[75] Inventor: Patrick D. King, Rantoul, Ill.

[73] Assignee: Flo-Con Systems, Inc., Champaign, Ill.

[ * ] Notice: The portion of the term of this patent subsequent to Feb. 2, 1999, has been disclaimed.

[21] Appl. No.: 190,429

[22] Filed: Sep. 24, 1980

Related U.S. Application Data

[63] Continuation-in-part of Ser. No. 89,577, Oct. 29, 1979, Pat. No. 4,313,596.

[51] Int. Cl.[3] ..... C21C 7/10; B22D 37/00

[52] U.S. Cl. ..... 266/44; 266/207; 266/236; 222/607; 164/337

[58] Field of Search ..... 266/44, 207, 236; 222/599, 600, 607; 164/337, 437

[56] References Cited

U.S. PATENT DOCUMENTS

| | | | |
|---|---|---|---|
| 3,627,353 | 12/1971 | Blumenfeld et al. | 285/39 |
| 3,963,224 | 6/1979 | Pollard | 266/207 |
| 4,084,799 | 4/1978 | Coward | 266/207 |
| 4,091,861 | 5/1978 | Thalmann | 164/437 |
| 4,131,220 | 12/1978 | Bode et al. | 164/607 |
| 4,211,390 | 7/1980 | Poole et al. | 266/207 |
| 4,222,505 | 9/1980 | Daussan et al. | 222/607 |
| 4,262,827 | 4/1981 | De Masi et al. | 222/607 |
| 4,313,596 | 2/1982 | King | 266/207 |

FOREIGN PATENT DOCUMENTS

| | | |
|---|---|---|
| 874886 | 7/1971 | Canada . |
| 909293 | 9/1972 | Canada . |
| 2621557 | 4/1977 | Fed. Rep. of Germany . |
| 1157818 | 9/1965 | United Kingdom . |

*Primary Examiner*—L. Dewayne Rutledge
*Assistant Examiner*—Alan E. Schiavelli
*Attorney, Agent, or Firm*—Jack E. Dominik

[57] ABSTRACT

Shown is a method for preventing or reducing cracking in collector nozzles in teeming vessels by securing the shroud underneath the nozzle with a predetermined load, sufficient to cause fluid tight connection between the shroud and the collector nozzle, and yet not enough to crack the collector nozzle. The shroud is urged against the nozzle and supported there by a boom which is free to move with the nozzle and thus becomes slaved to the movement of the nozzle and not its support. In addition, the desirability of removing the shroud from the pouring vessel by tilting it is preserved, and at the same time locking the shroud against pivotal motion is provided which reduces, if not eliminates, the excessive loads that can be caused when the shroud or the valve move, and the lower end is restricted for such movement by the poured fluid, thereby resulting in excessively multiplied loads on the collector nozzle. The apparatus discloses a boom which is pivotally mounted in a horizontal plane and permitted to raise upwardly at a predetermined static load dictated by dead weights which are empirically adjusted for the particular operation. In addition, the shroud, while pivotally mounted on the end of the boom, is locked in a position coaxially with the axis of the collector nozzle during the pour operation to inhibit side loads being formed which, when translated through the interface between the shroud and the collector nozzle, can cause the collector nozzle to crack and have metal break-out within the valve.

5 Claims, 9 Drawing Figures

SHROUD SUPPORT AND METHOD FOR SHROUD ENGAGEMENT WITH TEEMING VALVE

CROSS-REFERENCE TO RELATED APPLICATIONS

The present application is a continuation-in-part application of patent application Ser. No. 089,577 filed Oct. 29, 1979, now U.S. Pat. No. 4,313,596 entitled "SHROUD SUPPORT AND METHOD FOR SHROUD ENGAGEMENT WITH TEEMING VALVE", by the same inventor herein.

SUMMARY OF THE ART

In the pouring of steel from a ladle to a tundish, and in other instances of pouring, higher qualities of metals can be produced by the exclusion or reduction of stream contact with atmospheric oxygen. This is and has been done by teeming the metal through a shroud or submerged pour tube. Heretofore shrouds have been carried directly on sliding gate valves, or on other bottom pour vessels, or supported on a separate shroud supporting device that enables the shroud to be changed or removed during the teeming operation.

The principal prior art devices utilize a pivot to secure the shroud at its upper portion to a boom, and the boom is normally power operated against the underneath portion of the valve. Some such pour tubes are several feet in length, and as they are moved backwardly and forwardly while the slide gate throttles or goes from the "On" to the "Off" position, the intertial load on the lower portion is multiplied by bending the same over the fulcrum mount with a resulting strong uneven force at the underneath portion of the nozzle which, when translated up the nozzle, can crack the same. Once the collector nozzle is cracked, break-out of molten metal can readily take place into the valve.

The power source oftentimes being hydraulic, pneumatic, or electric, can fail and the upper end of the shroud loses contact with the collector nozzle. This further results in a break-out of metal. In addition, by utilizing hydraulic, pneumatic, and/or electrical power, the force of the human body is no longer a factor, and loads can be inadvertently placed at the interface between the collector nozzle and the upper portion of the pour tube or shroud which will augment the cracking effect and break-out.

The prior art is further exemplified by U.S. Pat. Nos. 3,963,224 and 4,084,799 relating to shrouds for bathing the stream of molten fluid in an inert gas, and also to U.S. Pat. Nos. 4,091,861, 4,131,220 and 3,627,353 and Great Britain Pat. No. 1,157,818, West German Pat. No. 2,621,557, Canadian Pat. No. 874,886 and Canadian Pat. No. 909,793, relating to the positioning of extended pouring tubes beneath a sliding gate type valve.

SUMMARY

The present invention is directed to a method for preventing or reducing cracking in collector nozzles in teeming vessels by securing the shroud or submerged pouring tube underneath the nozzle with a predetermined load, sufficient to cause fluid tight connection between the shroud or submerged pouring tube and the collector nozzle, and yet not enough to crack the collector nozzle. The shroud or submerged pouring tube is urged against the nozzle and supported there by a boom which is free to move with the nozzle and thus becomes slaved to the movement of the nozzle and not its support. In addition, the desirability of removing the shroud or submerged pouring tube from the pouring vessel by tilting it is preserved, and at the same time locking the shroud or submerged pouring tube against pivotal motion is provided which reduces, if not eliminates, the excessive loads that can be caused when the shroud or the valve move, and the lower end is restricted for such movement by the poured fluid, thereby resulting in excessively multiplied loads on the collector nozzle.

The apparatus contemplates a boom which is pivotally mounted in a horizontal plane and permitted to raise upwardly at a predetermined static load dictated by dead weights which are empirically adjusted for the particular operation. In addition, the shroud or submerged pouring tube, while pivotally mounted on the end of the boom, is locked in a position coaxially with the axis of the collector nozzle during the pour operation to inhibit side loads being formed which, when translated through the interface between the shroud or submerged pouring tube and the collector nozzle, can cause the collector nozzle to crack and have metal break-out within the valve.

In view of the foregoing, it is a primary object of the present invention to provide a method for positioning a shroud or submerged pouring tube against a gate valve which will minimize break-out through cracked collector nozzles, and maximize safety by designing the unit for total manual operation.

Still another and related object of the present invention is to provide a shroud or submerged pouring tube support and boom mechanism which is inherently simple in construction, and can be manually operated by a single operator observing the pour.

Still another object of the present invention is to provide a method for supporting a shroud or submerged pouring tube against the lower portion of a gate valve on a teeming vessel to insure axial alignment of the shroud or submerged pouring tube with the axis of the collector nozzle, thereby upon securing the same rigidly reducing side loads and undue stresses in the collector nozzle.

A further object of the present invention is to support a shroud or submerged pouring tube beneath a collector nozzle with a minimal frictional load to permit the shroud to move laterally or vertically with the nozzle and moved by the nozzle free from other translatory forces.

Still another object of the present invention is to provide a shroud or submerged pouring tube support which is inherently less expensive to produce than that of the prior art, and yet provides numerous advantageous safety provisions.

DESCRIPTION OF ILLUSTRATIVE DRAWINGS

The foregoing objects and advantages of the present invention will become more apparent as the following description of an illustrative embodiment of the apparatus and method takes place, taken in conjunction with the accompanying illustrative drawings in which:

FIG. 7 is a front elevation of a second embodiment. In the second embodiment the one-hundred series of reference numerals are employed, with the suffix "a" where the parts are essentially common shown on each reference numeral;

DESCRIPTION

THE METHOD

The method of the present invention is directed to the positioning of a shroud or submerged pouring tube in operative engagement with a collector nozzle beneath a teeming vessel in such a fashion that it is restrained against axial movement, and more importantly, the restraining means at the upper portion of the shroud inhibits torsional or bending movements which would cause an undue force at the interface connection between the shroud and the collector nozzle. Simultaneously with this restriction, the shroud or pour tube is urged into its fluid tight relationship with the nozzle of the valve at the bottom of the vessel by means of dead weights, thereby eliminating the possibility of overdrive through hydraulics, or other means of power. Furthermore, the dead weight mechanism is employed in the method since it permits the entire operation to be controlled manually by a single operator, thereby rendering the operation of the unit less vulnerable to power stoppages, equipment failure, and overdrive. The dead weight engagement reactive force is proportioned to overcome the tare weight of the supporting means and the shroud, and place a load of approximately 200 pounds between the upper portion of the shroud or tube and the nozzle of the mechanism for pouring from the bottom of the vessel, usually a slide gate.

THE APPARATUS-FIRST EMBODIMENT

Figure 1:
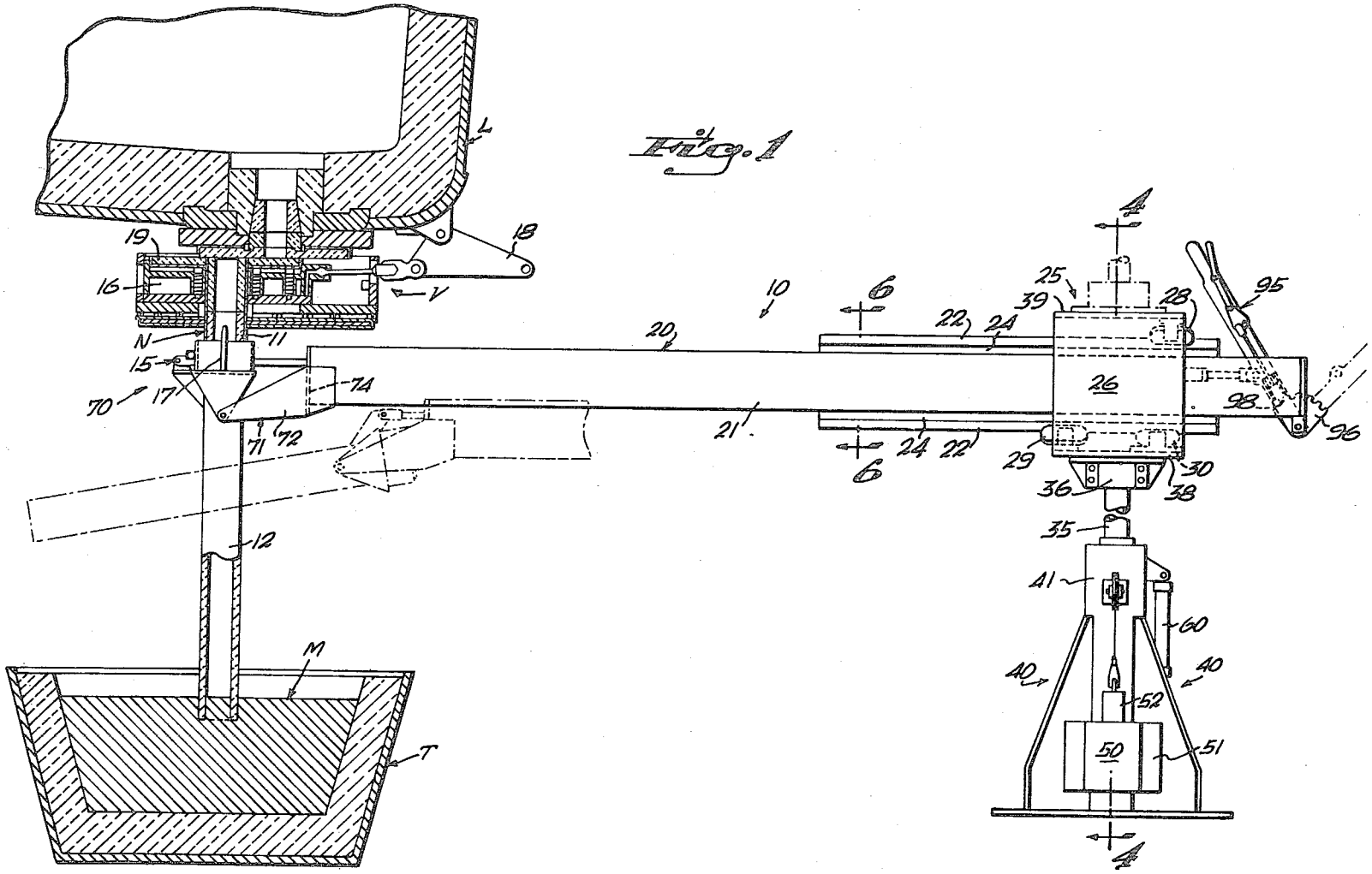
FIG. 1 is a front elevation, showing in partial section the ladle, valve, slide gate, pouring nozzle, and shroud or submerged pouring tube.

FIG. 1 shows a typical installation of the subject shroud support 10 in its operative relationship with a ladle L; a tundish T; a valve V; and showing further the position of the molten metal M within the tundish T. Hereinafter, as noted above, the terms shroud, pour tube, or submerged pour tube are used interchangeably.

Figure 2:
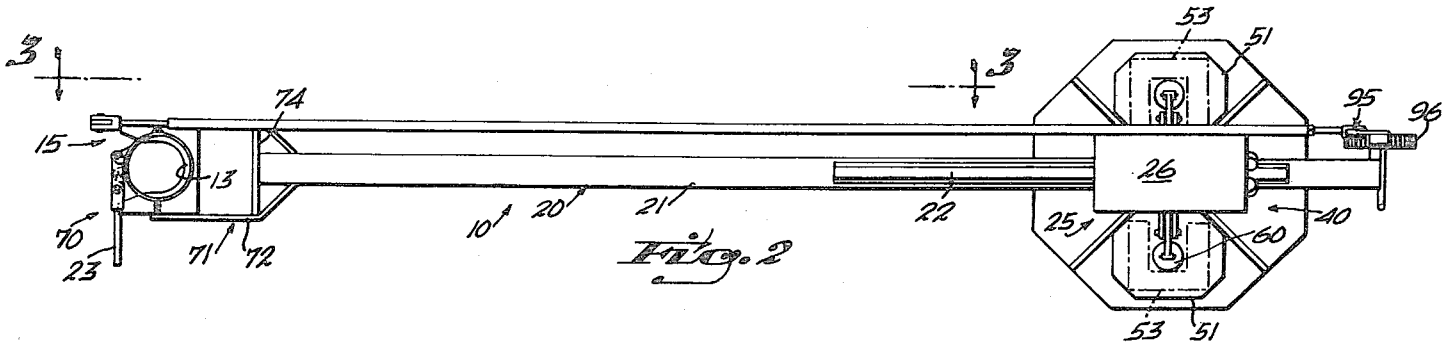
FIG. 2 is a top view of the construction shown in FIG. 1 omitting the ladle and valve.

The shroud support assembly 10 is provided to engage the collector nozzle 11 of the valve V with the shroud 12 as shown in FIG. 1. A crescent shaped shelf 13 (see FIG. 5 also) is provided at the lower portion of the collar 14. The clamp 15 comprises a circular band as shown at the left-hand portion of FIG. 2, secured in place by the clamp arm assembly 23.

To be noted is that the carrier 16 of the valve V reciprocates when actuated by the actuator 18, and this action is translated to the boom 20 when the slide gate 29 is moved, the slide gate being operatively coupled to the boom assembly 20 by means of the drive pin 17 which extends into the metallic portion of the valve V.

Figure 6:
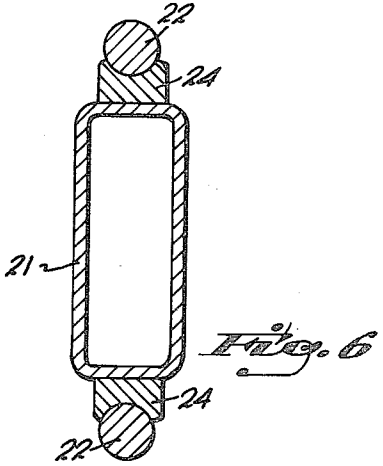
FIG. 6 is a sectional view through the boom tube.

As noted in FIG. 6, the tube 21 which comprises the boom 20 carries a rail 22 at its upper and lower portions 24. The purpose of the rails 22, to be detailed later, is to assist in supporting the boom assembly 20 in a minimum frictional relationship with its boom support assembly 25 to the end that the shroud 12 "floats" with the movement of the carrier 16 of the valve V.

The boom support assembly or head 25 has a support housing 26 which essentially surrounds the same, and provides interiorly (see FIG. 4) upper V roller bearings 28 which ride on the upper rail 22; and lower V bearing assembly 29 which ride on the lower rail 22. A stabilizer single bearing 30 assembly is provided at the rear portion and underneath in the support housing 26 and under normal load conditions is not contacted, but is provided to maintain both rails 22 in alignment in event of vibration or abrupt motion. The bearing support 31 for the stabilizer bearing assembly 30 is mounted on the support housing 26 and contains a single roller 32.

The boom support 25 and its housing 26 are secured by means of a support shaft 35 secured by means of a collar 36 to the boom support 25. More specifically, the collar 35 is secured to the base 38 of the support housing 26. The top 39 of the support housing 26 may be optionally used as shown in phantom lines at the upper portion of the boom support 25 when the boom support 25 is to be secured from an upper member as distinguished from being mounted on a platform as illustrated here.

The load stand 40 receives the support shaft 35 and includes an outer tube 41 and a tube insert 42 which are journaled for both rotation of the shaft 35 and raising and lowering of the shaft 35. This action in moving the shaft 35 is accomplished through the yoke assembly 45 secured by a yoke clamp 46 to the support shaft base 49, thrust bearings 48 being interposed between the yoke clamp 26 and the support shaft base 49 to insure freedom for rotation with as little frictional resistance as possible.

The weight assembly 50 includes the pair of opposed dead weights 51 (shown in top view of FIG. 2) and the dead weights 51 are secured about the weight support 52. It will be appreciated that extra weight 53 may be positioned atop the fixed dead weight 51.

The downward force of the dead weight 51 and the extra weights 53 is transmitted through weight cable 54 and weight pulley 55 to the yoke assembly 45, and secured by means of pulley bracket 56 to the tube 41 forming the outer portion of the load stand 40.

Figure 4:
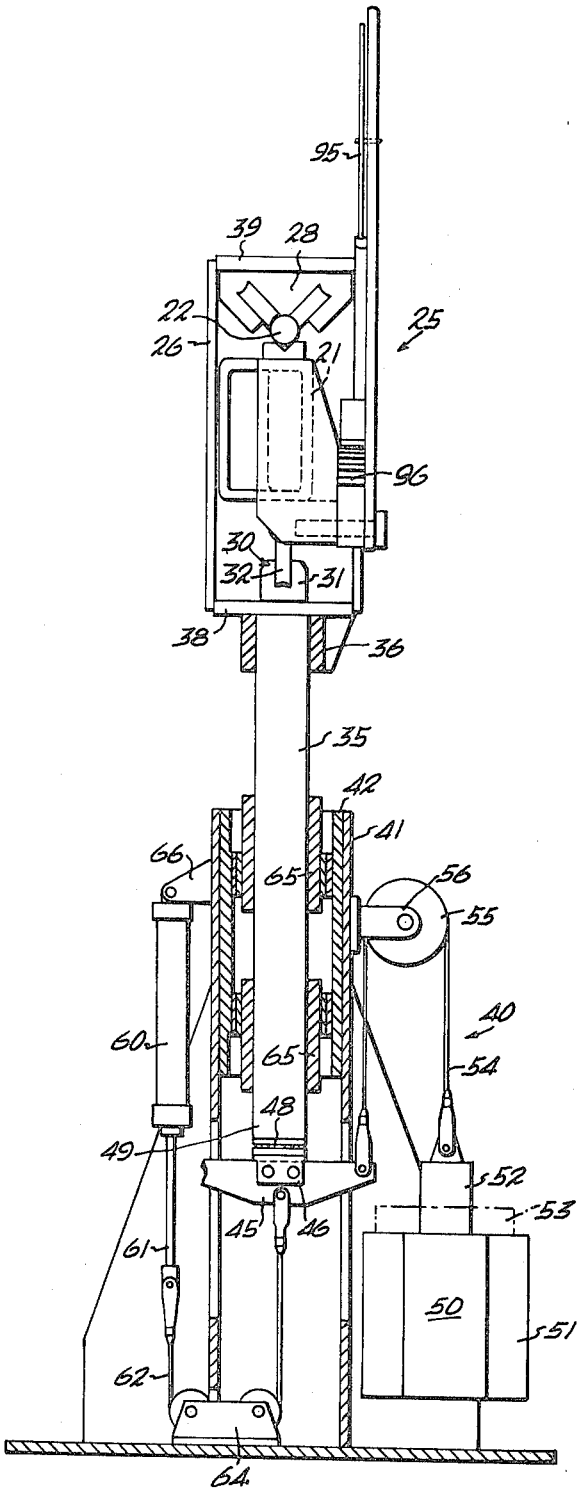
FIG. 4 is a vertical section of the support member taken generally along the line shown as 4—4 of FIG. 1.
Figure 2:
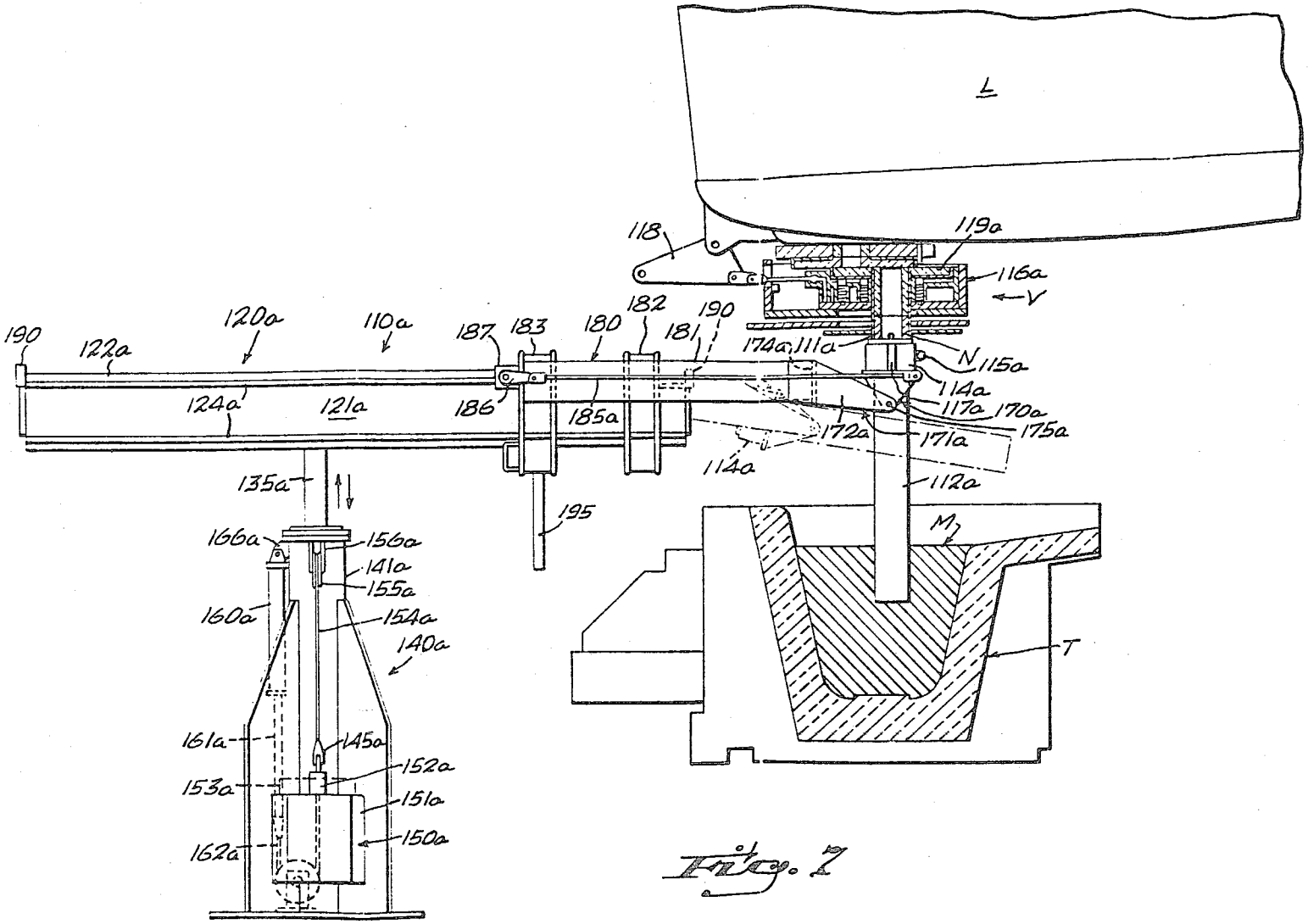

When it is desired to remove the shroud 12 from its operative engagement with the valve V to the condition shown in phantom lines in FIG. 1, a down cylinder 60 (see FIGS. 1 and 4) is actuated and then the down cylinder rod 61 acts upon the down cylinder cable 62 through pulley 64 which engages the underneath portion of the yoke assembly 45 and operatively pulls the same downwardly along with the entire boom support 25 and its associated boom to the position shown in phantom lines in FIG. 1, or any other lowered position. Prior to removal there may be a need to rotate the boom about the axis of rotation of the support shaft 35, and this is assisted by means of the support shaft bearings 65 shown in FIG. 4. Also shown in FIG. 4 is the mount 66 for the down cylinder 60.

Figure 3:
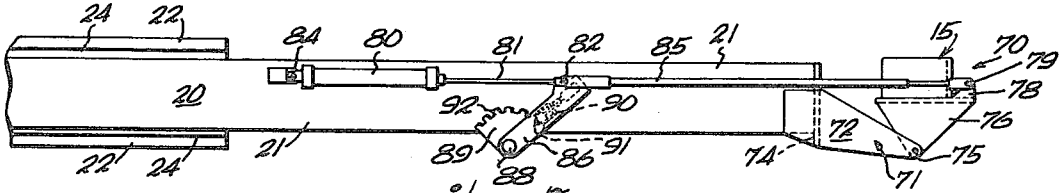
FIG. 3 is a partial rear view of the boom support and tilt mechanism taken from the position 3—3 of FIG. 2.

The tilt assembly 70 is shown primarily in FIG. 3 where it will be seen that the cradle 71 having parallel opposed cradle arms 72 and a back mount 74 which is secured to the boom tube 21 houses the pivot 75 and also the crank 76 for tilting the clamp assembly 15 and its associated shroud 12. A drive bracket 78 extends upwardly from the crank 76 and is provided with a drive pivot 79 securing the drive rod 81 in coupled operative relationship with the drive cylinder 80. The opposite end of the drive rod 81 is secured to the pivot 82 and the drive cylinder pivotally engaged through mounting pivot 84 to the tube 21 of the boom assembly 20. Further, a drive rod 85 is attached between drive pivot 79 and intermediate pivot 82.

The parallelogram for the actuation of the clamp 15 is completed by means of the parallelogram arm 86 secured about the arm pivot 88 and provided with a sector gear 89 and sector lock 90. The sector lock 90 has a sector lock tooth 91 which engages the teeth 92 of the sector gear 89, and provides at its extreme position shown in FIG. 3 a positive lock for the clamp assembly 15 with an axis essentially perpendicular to that of the boom assembly 20, thereby insuring perpendicularity of the shroud 12, and a coaxial relationship between the shroud 12 and the collector nozzle N of the valve assembly V. The control crank 95 (see FIG. 1) actuates the operation of the drive cylinder 80, and has a corresponding control crank gear sector 96 and engagement tooth 98 which are linked mechanically or hydraulically to duplicate the action of the control crank 95 with the parallelogram arm 86.

Figure 5:
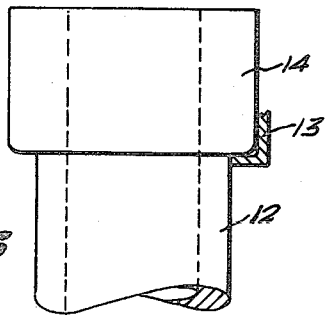
FIG. 5 is an enlarged partially diagrammatic view showing the relationship between the crescent shelf of the shroud support and the collar of the shroud or tube.

In review it will be seen that a boom assembly 20 has been shown and described securing the boom at one end to a boom support 25 in a relatively friction-free environment, and urged by a dead weight assembly 50 into pressure contact between the carried shroud and the collector nozzle N of the valve V. More specifically, as shown in FIG. 5, the collar 14 of the shroud 12 rests atop the crescent shelf of the clamp 15, and effectively the dead weight is urged by means of the crescent shelf 13 to maintain the upper portion of the collar 14 in pressure engagement with the lower portion of the collector nozzle N, all being secured in alignment by means of the drive pin 17 which engages a metallic extension of the slide gate valve V.

In operative effect, once the shroud 12 is coupled to the valve V, the movement of the carrier 16 of the valve V becomes the master, and the shroud 12 behaves in following the same in a slave-like relationship. It will be appreciated that when the ladle L is full of steel, and it is supported by cables, as the metal is poured from the lade L, the weight on the cables decreases and the ladle L will actually move upwardly. Because of the dead weight assembly 50, the shroud will similarly move upwardly and the boom 20 will follow. The same is true when the valve carrier 16 is actuated to turn the pour off or turn it on again. In all such instances the shroud 12 is permitted to behave as though it was an integral portion of the valve V, but nonetheless the load at the interface between the shroud 12 and the collector nozzle N is provided exclusively by the dead weight assembly 50, and thus remains essentially constant during all conditions except at the time of removal. Upon removal, the boom 20 is lowered by means of activating the down cylinder 60, and thereafter the shroud may be tilted as shown in phantom lines in FIG. 1. All control takes place by the operator who is a safe distance from the ladle, and actuating the various controls adjacent the boom support 25.

THE APPARATUS-SECOND EMBODIMENT

The shroud support 110*a* of the second embodiment shown in FIG. 7 operates to secure a shroud 112*a* against a nozzle N or 111*a* on a sliding gate valve V which is positioned beneath a ladle L to pass molten metal M into a tundish T. The shroud 112*a* has a collar 114*a* at its upper portion to which is secured a crescent shelf 113*a* (see FIG. 8) by means of a clamp 115*a* on a tilt assembly 170*a* (the latter to be described hereinafter). The valve V includes a carrier 116*a* to which a drive pin 117*a* is secured thereby locking the relationship between the shroud 112*a* and the nozzle N, 111*a* during pouring. The movement of the carrier 116*a* is controlled by the carrier actuator 118*a* as it moves the slide gate 119*a*.

Figures 8, 9:
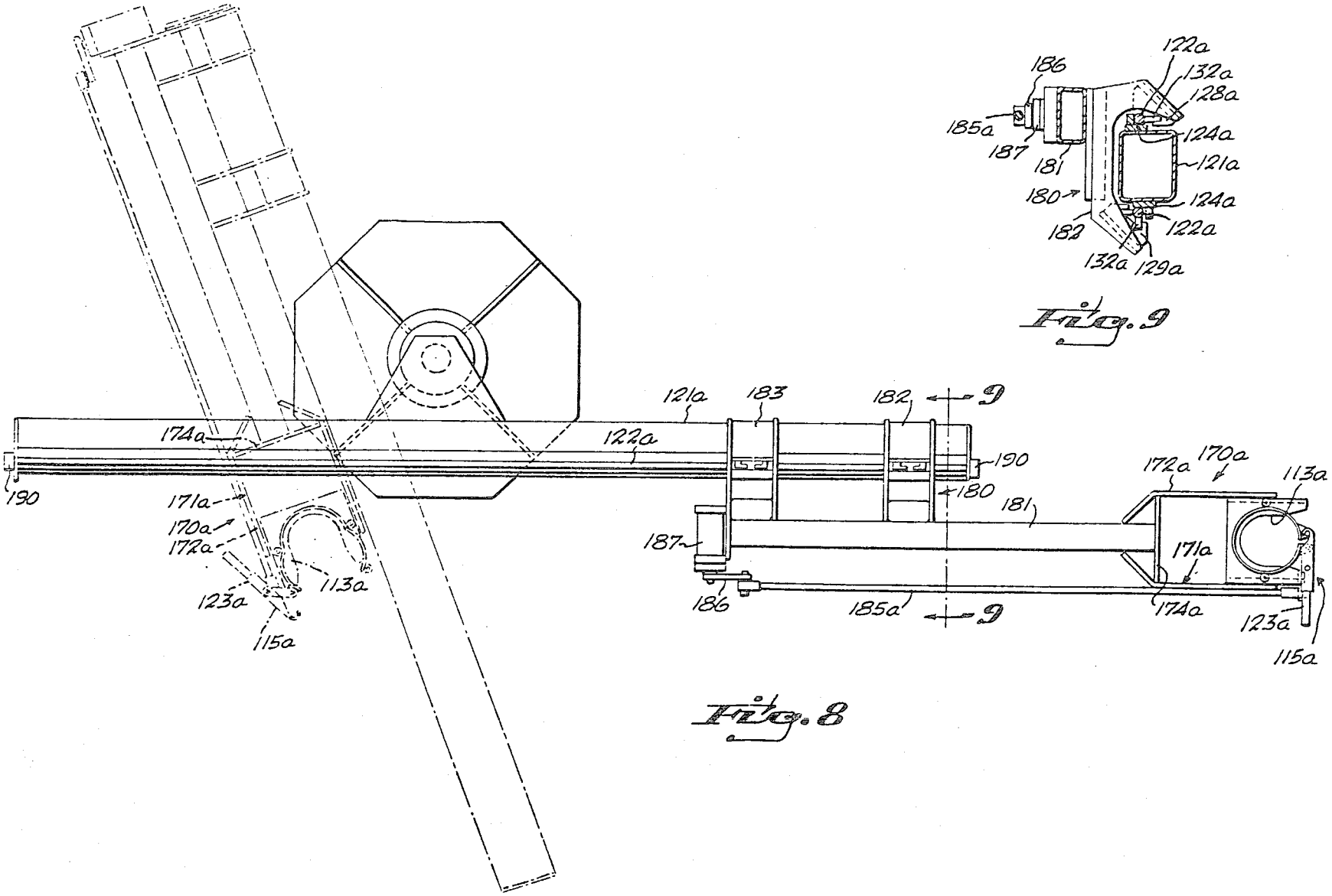
FIG. 8 is a top view of the second embodiment shown in FIG. 7 and in essentially the same scale.
FIG. 9 is a transverse sectional view of the trolly and secondary boom taken along section line 9—9 of FIG. 8.

The boom assembly 120*a*, in the second embodiment, includes a boom tube 121*a* which, as shown in FIG. 9, has upper and lower rails 122*a* and upper and lower rail supports 124*a*.

Differing from the first embodiment, the second embodiment includes a trolley 180 having a trolley boom 181 including front roller bracket 182 and rear roller bracket 183. The respective roller brackets 182, 183 include an upper bearing assembly 128*a* and a lower bearing assembly 129*a* which, in turn, support rollers 132*a* to ride against the rails 122*a*, all as shown in FIG. 9. The fixed tube 121*a* of the boom assembly 120*a* rides atop a support shaft or mast 135*a* which, in turn, may move upwardly and downwardly as well as pivotally about the load stand 140*a*, and is housed interiorly of the tube 141*a* with the interior construction being substantially identical with that shown in FIG. 4 in the first embodiment as described above. The yoke assembly 145*a* is secured to the weight assembly 150*a* and the dead weights 151*a* by means of the weight support 152*a*. The weight cables 154*a*, weight pulleys 155*a*, and the pulley brackets 156*a* as well as the additional dead weight 153*a* are essentially the same as in the first embodiment. In addition, a down cylinder 160*a* along with a down cylinder rod 161*a* and down cylinder cable 162*a* actuate the weight assembly 150*a* in the second embodiment in substantially the same fashion as in the first embodiment.

In the second embodiment, the tilt assembly 170*a* for the shroud 112*a* is essentially the same as in the first embodiment, with the shroud being secured in position on the tilt assembly 170*a* by actuating the clamp arm 123*a*. The cradle 171*a* includes arms 172*a* which are secured by means of the bat mount 174*a* to the trolley boom 181. The tilt assembly, as shown in FIG. 7, pivots about pivot pin 175*a*. When it is desired to remove the shroud from the tundish T, as shown in phantom lines in FIG. 7, the drive rod 185*a* is actuated by the drive rod crank 186 through the drive rod actuator 187 moving counterclockwise as shown in FIG. 7. The trolley 180 is then retracted to telescope along the boom 120*a* by means of the trolley handle 195 which is manipulated by the operator. The travel of the trolley 180 is fixed by means of trolley stops 190 located at both ends of the tube 121*a* of a fixed boom assembly 120. As shown particularly in FIG. 8, it will be seen that the tilt assembly 170*a* can be moved into position closely adjacent to the load stand 140*a* for removal and replacement. Thus the configuration of the second embodiment permits telescopingly reducing the length of travel of the composite fixed boom 120*a* and the trolley assembly 180 along with its trolley boom 181. Nonetheless the basic objects of the method and apparatus are achieved by substantially identical weight assemblies 50, 150*a* utilizing dead weights 51, 151*a* to position the shroud in dead weight engagement with the nozzle of the valve.

Although particular embodiments of the invention have been shown and described in full here, there is no intention to thereby limit the invention to the details of such embodiments. On the contrary, the intention is to cover all modifications, alternatives, embodiments, usages and equivalents of a shroud support and method for shroud engagement with teeming valve as fall within the spirit and scope of the invention, specification, and the appended claims.

I claim:

1. A shroud support for use with a bottom pour vessel having a sliding gate valve and pour nozzle comprising, in combination:

a fixed boom, means for pivotally securing the fixed boom to a boom support assembly, a trolley for sliding engagement along the fixed boom, a secondary boom secured to said trolley, a collar at the unsupported end of the secondary boom for the mounting of the shroud, means for pivotally securing the mounted shroud at the end of the trolley boom with selective fixed non-pivotal alignment coaxial with the teeming opening in the vessel which the shroud engages, a boom support for said fixed boom, means for pivotally mounting the fixed boom for rotation about the support, and mounting means for the same permitting raising and lowering of the fixed boom, dead weight means provided in the boom support for constantly urging the entire fixed boom, trolley and secondary boom assembly along with the shroud upwardly at a predetermined load, means for opposing the dead weight raising of the boom to thereby lower the same, and means for pivotally moving the shroud from its normal coaxially aligned relationship with the nozzle of the pour vessel for removal or replacement of the shroud.

2. In the shroud support for use with a bottom pour vessel having a sliding gate valve and pour nozzle of claim 1, a drive pin secured to the means for securing the mounted shroud at the end of the boom, and drive pin engaging means on the sliding gate for interlocking the same to thereby secure the shroud in coaxial alignment with the pour nozzle of the slide gate valve.

3. In the shroud support for use with a bottom pour vessel having a sliding gate valve and pour nozzle of claim 1, a tilt mechanism for the collar at the unsupported end of the trolley boom comprising a single drive rod, and an actuator and crank assembly at one end of the drive rod.

4. In the shroud support for use with a bottom pour vessel having a sliding gate valve and pour nozzle of claim 1, control means for raising and lowering the fixed boom, control means for tilting the collar on the trolley boom, and trolley handle means secured beneath the trolley, whereby an operator may move the shroud in and out of position from a location closely adjacent the means for pivotally mounting the fixed boom.

5. The method of fixing a shroud in pouring relationship with the lower portion of a gate valve comprising the steps of:

securing the shroud by means of a cantilever support for positioning underneath the vessel, securing mounting the shroud in a non-pivotal relationship with the end of the cantilever support and locking the same in coaxial pouring relationship with the valve, urging the shroud upper portion against the teeming valve by means of dead weights which are empirically determined to exert, above and beyond the tare weight of the shroud, a predetermined interfacial force between the shroud and the valve, moving the mounted shroud in and out of engagement with the pouring valve for translation along an X axis, Y axis, and Z axis, and telescoping said cantilever support between a fixed element and a movable element slidable on said fixed element.

* * * * *